US008703686B2

(12) United States Patent
Agarkhed et al.

(10) Patent No.: US 8,703,686 B2
(45) Date of Patent: Apr. 22, 2014

(54) TRANSPARENT SOAP COMPRISING FLUORESCER

(75) Inventors: Ajit Manohar Agarkhed, Mumbai (IN); Abir Chatterjee, Mumbai (IN)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 14/007,694

(22) PCT Filed: Mar. 26, 2012

(86) PCT No.: PCT/EP2012/055318

§ 371 (c)(1), (2), (4) Date: Sep. 26, 2013

(87) PCT Pub. No.: WO2012/136502

PCT Pub. Date: Oct. 11, 2012

(65) Prior Publication Data

US 2014/0024573 A1 Jan. 23, 2014

(30) Foreign Application Priority Data

Apr. 6, 2011 (IN) ..... 1153/MUM/2011
Jun. 28, 2011 (EP) ..... 11171613

(51) Int. Cl.
*A61Q 5/00* (2006.01)

(52) U.S. Cl.
USPC ..... 510/141; 510/152; 510/153; 510/155

(58) Field of Classification Search
None
See application file for complete search history.

(56) References Cited

U.S. PATENT DOCUMENTS

| | | | | |
|---|---|---|---|---|
| 4,490,280 | A | 12/1984 | Joshi et al. | |
| 5,417,876 | A | 5/1995 | Tokosh et al. | |
| 2009/0062169 | A1* | 3/2009 | Wis-Surel et al. | 510/146 |

FOREIGN PATENT DOCUMENTS

| | | | |
|---|---|---|---|
| EP | 0335027 | A1 | 10/1989 |
| EP | 0709453 | A2 | 5/1996 |
| EP | 2154234 | A1 | 2/2010 |
| WO | WO0109277 | A1 | 2/2001 |
| WO | WO03035820 | A1 | 5/2003 |

OTHER PUBLICATIONS

European Search Report on Application No. EP 1117163 dated Dec. 9, 2011.
PCT International Search Report and Written Opinion on Appln. No. PCT/EP2012/055318 dated Jul. 18, 2012.

* cited by examiner

*Primary Examiner* — Necholus Ogden, Jr.
(74) *Attorney, Agent, or Firm* — Ronald A. Koatz

(57) ABSTRACT

It has been found that transparency and water-white appearance of soap bars is improved by adding a fluorescer at selective levels. Disclosed is a transparent soap bar comprising: (i) 20 to 78 wt % total fatty matter; and (ii) 0.003 to 0.5 wt % fluorescer, wherein (i) CIELAB b* value of said bar at 0° viewing and 75° illumination is less than 0; and (ii) color of said bar expressed as Y+5R on LOVIBOND® scale is 0 to 3 and wherein the soap bar includes 0.05 to 10 wt % C2 to C3 alcohol. Also disclosed is a process for making transparent soap bar comprising the steps of: (i) saponification of oils or fatty acids in presence of polyols to get a molten mass, where after complete neutralization, the free alkali content measured as sodium hydroxide is not greater than 0.1%; and (ii) molding said molten mass to get the bar, wherein 0.003 to 0.5 parts fluorescer and 0.05 to 10 parts C2 to C3 alcohol is mixed with said molten mass.

14 Claims, No Drawings

TRANSPARENT SOAP COMPRISING FLUORESCER

The present invention relates to transparent soap bars.

Any discussion of the prior art throughout the specification should in no way be considered as an admission that such prior art is widely known or forms part of the common general knowledge in the field.

Transparent soaps are aesthetically superior to opaque bars. A well-known example is PEARS®. Such bars are transparent because soap is deposited from an alcoholic solution in transparent and microcrystalline form.

Transparent soap bars usually contain polyols or alcohols, or both. These ingredients are believed to be primarily responsible for transparency. Such soaps usually contain high levels of sodium or potassium soaps of fatty acids, or both; usually 45% or more. Further, the pH of aqueous solutions of such bars is usually around 8.5 to 9.5. These soaps are believed to be substantially less irritating than conventional opaque soap bars.

Many commercially available transparent soap bars have amber colour. This colour may be an inherent property of the fatty acids, or it may be due to reactions that occur during processing. The dark colour may also be due to essential oils and perfumes, especially extracts of some herbs or spices which are generally included for functional benefits, such as mildness. Although bleaching may help lighten the colour, it may destroy the essential oils, perfumes and extracts.

Reducing agents, such as sodium bisulphite may be used to lighten the colour. EP 335027 A1 (Unilever, 1989) discloses that dark colour of transparent bars may be reduced by a combination of a sulphur (sodium metabisulphite) and a hydride type reducing agent (sodium borohydride) at particular ratios offers a solution.

EP0709453 A2 (Vioryl Chemical and Agriculture) discloses a method for the production of transparent solid soap starting from glycerides, fatty acids and multivalent alcohols. The application describes that addition of 1 to 5 wt % hydroxy polycarbonic or polyhydroxy polycarbonic acid esters improve transparency and appearance of the soap bars, and the addition of stilbene and hydroxy benzophenone derivatives or 4-alkoxy cinnamates reduces rancidity.

U.S. Pat. No. 5,417,876 A (Avon Products INC, 1995) discloses transparent soap bars having a fluorescer, although no particular benefit has been attributed to it. Colour and transparency have been disclosed in generic terms. Neither is there any reference to the CIELAB b* nor any quantitative measure of the color of the bars is disclosed. Disclosed soap bars are devoid of volatile alcohols. In such cases, it is difficult to get a right balance between transparency and the color of the bar.

We have determined that such compositions devoid of volatile short chain monohydric alcohols have darker color.

WO03/035820 A1 (Colgate-Palmolive) discloses a solid translucent or transparent soap composition comprising a cleansing effective amount of soap and an anti-discoloration effective amount of Tinogard TL®, which is Benzotriazole 2-(2H-benzotriazol-2-yl)-6-dodecl-4-methylphenol. WO01/09277 A1 also by Colgate-Palmolive discloses use of Burmetrazole for the same purpose.

Although the applications disclose "b" values of the bars to indicate yellowing, there is no indication of the color of the bars on any measurable scale. Further, the disclosure suggests that the bars should have a colorant and for this reason the technical benefit is prevention or reduction of discoloration that happens upon exposure to sunlight.

During the process of making transparent soap bars, oils or fatty acids are saponified in the presence of polyols. During saponification, the temperature is generally around 90 to 95° C., and it may increase to about 110° C. Uncontrolled increase may result in dark brown bars. Consumers do not prefer such bars.

We have determined that transparency and water-white appearance of soap bars may be improved by adding a fluorescer at selective levels.

According to a first aspect, the invention provides transparent soap bar comprising:

(i) 20 to 78 wt % total fatty matter; and, (ii) 0.003 to 0.5 wt % fluorescer, wherein (i) CIELAB b* value of the bar at 0° viewing and 75° illumination is less than 0; and, (ii) color of the bar expressed as Y+5R on LOVIBOND® scale is 0 to 3 and wherein the soap bar includes 0.05 to 10 wt % $C_2$ to $C_3$ alcohol.

The bars also show a bluish tinge when seen under visible light, and especially when seen against sunlight.

According to a second aspect the invention provides a process for making transparent soap bar of the first aspect, the process including the steps of:

(i) saponification of oils or fatty acids in presence of polyols to get a molten mass, where after complete neutralisation, the free alkali content measured as sodium hydroxide is not greater than 0.1%; and, (ii) molding the molten mass to get the bar, wherein 0.003 to 0.5 parts fluorescer and 0.05 to 10 parts $C_2$ to $C_3$ alcohol is mixed with said molten mass.

It should be noted that in specifying any range of concentration or amount, any particular upper concentration can be associated with any particular lower concentration or amount.

For better understanding of the invention; reference should be made to the following detailed description of preferred embodiments.

In an aspect, the invention provides transparent soap bar comprising:

(i) 20 to 78 wt % total fatty matter; and, (ii) 0.003 to 0.5 wt % fluorescer, wherein (i) CIELAB b* value of said bar at 0° viewing and 75° illumination is less than 0; and, (ii) color of said bar expressed as Y+5R on LOVIBOND® scale is 0 to 3 and wherein the soap bar includes 0.05 to 10 wt % $C_2$ to $C_3$ alcohol.

Transparency can be measured with commercially available lux meters. A lux meter is a device which measures brightness of objects. It specifically measures the intensity with which brightness appears to the human eye. This is different from measurements of the actual light energy produced by or reflected from an object or light source.

The lux is a unit of measurement of brightness, or more accurately, illuminance. It ultimately derives from the Candela, the standard unit of measurement for the power of light. A Candela is a fixed amount, roughly equivalent to the brightness of one candle.

While measuring transparency of bars, the Candela of incident visible light from an incandescent source is set to, or fixed at 100 units. A soap bar is then placed between the source of light and the sensor. Then the percentage of light passing through the bar is measured. It is preferred that 30 to 70% of the incident visible light passes through the bars. Further preferably, 40 to 65%, and most preferably 55 to 65% light passes through the bars.

The bar may have any shape, but preferred shapes are rectangular and oval. The preferred dimensions of the bar are:

Major axis—70 to 100 mm, more preferably 75 to 85 mm.

Minor axis—40 to 80 mm, more preferably 50 to 65 mm

Thickness—10 to 30 mm, more preferably 15 to 25 mm

The Bar Composition

Soap

The term soap means sodium or potassium salts of fatty acids. Preferably, the soap is soap of $C_8$ to $C_{22}$ fatty acids, more preferably of $C_{10}$ to $C_{18}$ fatty acids. It is particularly preferred that the soap includes at least 30% soaps of $C_{12}$ to $C_{14}$ fatty acids, more preferably at least 40% and most preferably at least 50% of the total soap content.

The cation of the soap may be an alkali metal, alkaline earth metal or ammonium ion, preferably alkali metals. Preferably, the cation is selected from sodium or potassium. The soap may be saturated or unsaturated. Saturated soaps are preferred over unsaturated soaps for stability. The oil or fatty acids may be of vegetable or animal origin.

The soap may be obtained by saponification of oils, fats or fatty acids. The fats or oils generally used in soap manufacture may be selected from tallow, tallow stearins, palm oil, palm stearins, soya bean oil, fish oil, castor oil, rice bran oil, sunflower oil, coconut oil, babassu oil, and palm kernel oil. The fatty acids may be from coconut, rice bran, groundnut, tallow, palm, palm kernel, cotton seed or soyabean.

The fatty acid soaps may also be synthetically prepared (e.g. by the oxidation of petroleum or by the hydrogenation of carbon monoxide by the Fischer-Tropsch process). Resin acids, such as those present in tall oil, may also be used. Naphthenic acids may also be used.

Preferred soap bars are made of commercially available 20:80 mixture of sodium palm kernelate and sodium palmate. The mixture has about 82% soaps, 1% sodium chloride and 17% water (moisture).

The term water-soluble soap wherever used in this description means soap having solubility greater than 2 g/100 g water at 25° C. Preferred soap bars include at least 30%, more preferably at least 40% and most preferably at least 50% water-soluble soap, of the total soap content.

$C_2$-$C_3$ alcohol

The transparent soap bar also includes 0.05 to 10 wt % $C_2$ to $C_3$ alcohol. These include ethanol and isopropyl alcohol. Isopropyl alcohol is more preferred. The alcohol content of bars immediately after production may be slightly on the higher side, e.g. about 3 to 4 wt %, whereas the alcohol content of bars which have remained on the shelves of stores or supermarkets may be on the lower side, e.g. about 0.1 wt %.

Total Fatty Matter

The term total fatty matter, usually abbreviated to TFM, is used to denote the percentage by weight of fatty acids and triglyceride residues present in soap bars without taking into account the accompanying cations.

For a soap having 18 carbon atoms, an accompanying sodium cation will generally amount to about 8% by weight.

It is preferred that 60 to 100% of the total fatty matter is present in the form of alkali metal salts of fatty acids. It is preferred that 5 to 35% of said fatty acids is hydroxy fatty acids. It is preferred that the hydroxy fatty acids are ricinoleic acid or 12-hydroxy stearic acid. Soaps of such fatty acids are highly soluble, and they help in solubilising more amount of soaps in the liquid phase of the molten soap mass and help match Refractive index. This improves transparency.

TFM of the transparent soap bars is 20 to 78 wt %. The TFM of preferred bars is preferably 20 to 50 wt % and that of most preferred bars is 30 to 40 wt %.

Fluorescer

Fluorescers (also called fluorescent whitening agents or optical brighteners) convert a portion of UV-light into visible blue light which greatly increases the whiteness of an article and masks yellowness.

Fluorescers can belong to different chemical classes, but have a conjugated planar double bond system, are monomolecular, and the ability to absorb ultra-violet light between 300 to 400 nm, and emit visible blue light between 400 to 500 nm, with maxima around 430 to 436 nm.

Fluorescers are often based on stilbene, which is 1,1,diphenyl ethylene. The effect of fluorescers is fundamentally different from that from 'blueing agents' or "shading dyes" which only absorb yellow light and thus reduce brightness.

It is preferred that the fluorescer is water-soluble. Such fluorescers are better able to mix with molten soap mass and their distribution in the mass is homogenous.

Fluorescers are well known and many such fluorescent agents are commercially available. Usually, these fluorescent agents are supplied and used in the form of their alkali metal salts, for example, the sodium salts.

The transparent soap bar includes 0.003 to 0.5 wt % fluorescer, more preferably 0.005 to 0.01%, and most preferably 0.0075 wt % to 0.0015 wt %, with 0.01 wt % being particularly preferred. Bars with preferred levels of fluorescer have the most appropriate b* values. Amounts higher than 0.5 wt % would make the bars appear bluish.

Preferred classes of fluorescent whitening agents are distyryl biphenyl compounds, e.g. TINOPAL® CBS-X, di-amine stilbene di-sulphonic acid compounds, e.g. TINOPAL® DMS pure Xtra and BLANKOPHOR® HRH, and pyrazoline compounds, e.g. BLANKOPHOR® SN.

Preferred fluorescent whitening agent from these classes are sodium 2 (4-styryl-3-sulfophenyl)-2H-napthol[1,2-d] triazole, disodium 4,4'-bis{[(4-anilino-6-(N methyl-N-2 hydroxyethyl)amino 1,3,5-triazin-2-yl)]amino}stilbene-2-2' disulfonate, disodium 4,4'-bis{[(4-anilino-6-morpholino-1, 3,5-triazin-2-yl)]amino}stilbene-2-2' disulfonate, and disodium 4,4'-bis(2-sulfoslyryl)biphenyl.

Structures of some preferred fluorescent whitening agents are:

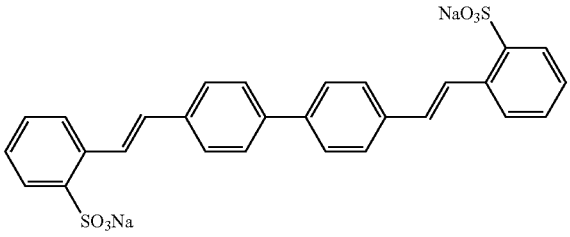

TINOPAL® CBS-X, which is 4,4-bis(2-disulfonic acid styryl)biphenyl.

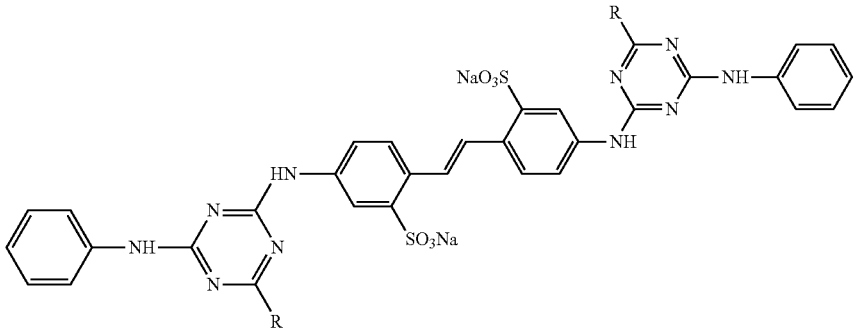

Diamino Stilbene Cyanuric Chloride

Other preferred fluorescent whitening agents include:

(i) dimorpholino type, e.g. TINOPAL® DMS-X, BLANKOPHOR® MBBH 766, LEUCOPHOR® DU, PHOTINE® CBUS/B and OPTIBLANC® 2MG, and (ii) tetra anilo type, e.g. TINOPAL® TAS, BLANKOPHOR® HZPA, LEUCOPHOR® DNH, PHOTINE® DK and OPTIBLANC® TPM.

Other types of fluorescent whitening agents that may be used are BLANKOPHOR® RKH766 and TINOPAL® 5BM-GX and TINOGARD® TT ex. Ciba which is Pentaerythritol tetrakis(3-(3,5-di-tert-butyl-4-hydroxyphenyl)propionate).

If instead of a fluorescent whitening agent, a blue dye is used, the bar may turn blue or green. Blue pigment CI 74168 gives blue coloured bars. On the other hand, pigments being particulate, may not distribute as uniformly as fluorescers.

The CIELAB b* value of the bars measured by a spectrophotometer at 0° viewing and 75° illumination is less than 0. The b* values may be measured on any spectrophotometer, but a preferred spectrophotometer is MINOLTA® CM-512 m3 Multi-Angle Spectrophotometer. The illuminant is $D_{65}$. CIE L*a*b* (CIELAB) is the most complete colour space specified by the International Commission on Illumination (Commission Internationale d'Eclairage).

It describes all the colours visible to the human eye and was created to serve as a device independent model to be used as a reference.

In use, a spectrophotomer is first calibrated twice, known as dark and white calibrations. The meter is then held onto a bar. A button is clicked and the b* value gets displayed on the display panel.

Lovibond® Scale

The color of the transparent bar expressed as Y+5R on LOVIBOND® scale is 0 to 3. The color of preferred bars expressed as Y+5R on the same scale 1 to 2.

The Lovibond® scale is based on a calibrated series of red, yellow and blue glasses. It is based on 84 calibrated glass colour standards of different densities of magenta (red), yellow, and blue, graduating from desaturated to fully saturated. Sample colours are matched by a suitable combination of the three primary colours together with neutral filters, resulting in a set of Lovibond® RYBN units that define the colour. It is possible to match the colour of almost any sample; it is particularly popular for measuring the colour of oils and fats, chemicals, pharmaceuticals and syrups.

To measure the colour of the bars on a LOVIBOND® tintometer, first a 20% solution of the soap bar is prepared in 1:1 ethanol-water solution. The solution is filled in 5.25" cell and the cell is placed inside the tintometer. The colour is measured at 50° C., and is expressed as Y+5R.

Co-Surfactant

In addition to the soap, preferred bars may include a co-surfactant selected from anionic, non-ionic, zwitterionic, amphoteric and cationic surfactants.

Preferred bars include 1 to 30 wt % co-surfactants. More preferred bars include 3 to 25 wt % co-surfactants and most preferred compositions include 5 to 15 wt % co-surfactants.

Suitable anionic surfactants include water soluble salts of organic sulphuric reaction products having in the molecular structure an alkyl radical containing from 8 to 22 carbon atoms, and a radical chosen from sulphonic acid or sulphuric acid ester radicals, and mixtures thereof.

Examples of suitable anionic surfactants are sodium and potassium alcohol sulphates, especially those obtained by sulphating the higher alcohols produced by reducing the glycerides of tallow or coconut oil; sodium and potassium alkyl benzene sulphonates such as those in which the alkyl group contains from 9 to 15 carbon atoms; sodium alkyl glyceryl ether sulphates, especially those ethers of the higher alcohols derived from tallow and coconut oil; sodium coconut oil fatty acid monoglyceride sulphates; sodium and potassium salts of sulphuric acid esters of the reaction product of one mole of a higher fatty alcohol and from 1 to 6 moles of ethylene oxide; sodium and potassium salts of alkyl phenol ethylene oxide ether sulphate with from 1 to 8 units of ethylene oxide molecule and in which the alkyl radicals contain from 4 to 14 carbon atoms; the reaction product of fatty acids esterified with isethionic acid and neutralized with sodium hydroxide where, for example, the fatty acids are derived from coconut oil and mixtures thereof.

The preferred water-soluble synthetic anionic surfactants are the alkali metal (such as sodium and potassium) and alkaline earth metal (such as calcium and magnesium) salts of higher alkyl benzene sulphonates and mixtures with olefin sulphonates and higher alkyl sulphates, and the higher fatty acid monoglyceride sulphates.

Suitable nonionic surfactants can be broadly described as compounds produced by the condensation of alkylene oxide groups, which are hydrophilic in nature, with an organic hydrophobic compound which may be aliphatic or alkyl aromatic in nature.

The length of the hydrophilic or polyoxyalkylene radical which is condensed with any particular hydrophobic group can be readily adjusted to yield a water-soluble compound having the desired degree of balance between hydrophilic and hydrophobic elements.

Particular examples include the condensation product of aliphatic alcohols having from 8 to 22 carbon atoms in either straight or branched chain configuration with ethylene oxide, such as a coconut oil ethylene oxide condensate having from 2 to 15 moles of ethylene oxide per mole of coconut alcohol; condensates of alkylphenols whose alkyl group contains from 6 to 12 carbon atoms with 5 to 25 moles of ethylene oxide per mole of alkylphenol; condensates of the reaction product of ethylenediamine and propylene oxide with ethylene oxide, the condensate containing from 40 to 80 percent of polyoxyethylene radicals by weight and having a molecular weight of from 5,000 to 11,000; tertiary amine oxides of structure $R_3NO$, where one group R is an alkyl group of 8 to 18 carbon atoms and the others are each methyl, ethyl or hydroxyethyl groups, for instance dimethyldodecylamine oxide; tertiary phosphine oxides of structure $R_3PO$, where one group R is an alkyl group of from 10 to 18 carbon atoms, and the others are each alkyl or hydroxyalkyl groups of 1 to 3 carbon atoms, for instance dimethyldodecylphosphine oxide; and dialkyl sulphoxides of structure $R_2SO$ where the group R is an alkyl group of from 10 to 18 carbon atoms and the other is methyl or ethyl, for instance methyltetradecyl sulphoxide; fatty acid alkylolamides; alkylene oxide condensates of fatty acid alkylolamides and alkyl mercaptans.

Suitable cationic surfactants that can be incorporated are alkyl substituted quarternary ammonium halide salts e.g. bis (hydrogenated tallow)dimethylammonium chlorides, cetyltrimethyl ammonium bromide, benzalkonium chlorides and dodecylmethylpolyoxyethylene ammonium chloride and amine and imidazoline salts for e.g. primary, secondary and tertiary amine hydrochlorides and imidazoline hydrochlorides.

Suitable amphoteric surfactants are derivatives of aliphatic secondary and tertiary amines containing an alkyl group of 8 to 18 carbon atoms and an aliphatic radical substituted by an anionic water-solubilising group, for instance sodium 3-dodecylamino-propionate, sodium 3-dodecylaminopropane sulphonate and sodium N-2-hydroxydodecyl-N-methyltaurate.

Suitable zwitterionic surfactants are derivatives of aliphatic quaternary ammonium, sulphonium and phosphonium compounds having an aliphatic radical of from 8 to 18 carbon atoms and an aliphatic radical substituted by an anionic water-solubilising group, for instance 3-(N—N-dimethyl-N-hexadecylammonium)propane-1-sulphonate betaine, 3-(dodecylmethyl sulphonium)propane-1-sulphonate betaine and 3-(cetylmethylphosphonium)ethane sulphonate betaine.

Free Fatty Acids

In addition to soaps, which are salts of fatty acids, preferred transparent soap bar may also include some free fatty acids. It is preferred that the free fatty acids is less than 4 wt %, more preferably less than 2 wt % and most preferably less than 1.5 wt %. Some amount of free fatty acids may improve the quantity and quality of the lather. Fatty acids also provide an emollient effect which tends to soften the skin or otherwise improve feel-on-skin characteristics and scavenge any excess alkalinity. Increase in the amount of free fatty acids may lead to crystallisation. These bigger sized crystals reduce the quantity of preferred small-sized crystals.

Crystals of small size are formed as a result of gradual evaporation of the $C_2$ to $C_3$ alcohol. It is believed that crystals of larger size may adversely affect transparency. Bars with higher amount of free fatty acids may also be softer, and softer bars may not be preferred by consumers. The carbon chain length of free fatty acids is preferably from $C_8$ to $C_{22}$, more preferably $C_{16}$ to $C_{18}$. Free fatty acids may include one or more of lauric acid, stearic acid, palmitic acid or a mixture thereof.

Polyol

Preferred transparent soap bar also includes 10 to 50 wt % polyols. More preferred bar includes 25 to 35 wt % polyols. Preferred polyols include glycerol, sorbitol, maltitol, propylene and ethylene glycols and higher alkoxylated derivatives.

Polyhydric alcohols, such as propylene glycol, may serve as diluents to thin out the otherwise thick mixture of caustic soda and fatty oils.

Other polyhyric alcohols such as glycerol perform as a humectant and moisturizer. A mixture of polyols is usually used.

Water

Preferred transparent soap bar includes 10 to 35 wt % water; more preferably 15 to 25 wt % water. More or lesser water may adversely affect transparency.

The pH of preferred bars is 8 to 11, more preferably 8.5 to 10.

Other Preferred Ingredients

In addition to the ingredients described earlier, preferred transparent soap bar may include other ingredients.

A preferred bar may include up to 30 wt % benefit agents. Preferred benefit agents are moisturisers, emollients, sunscreens and anti-ageing compounds. The agents may be added at an appropriate step during the process of making the bars. Some benefit agents may be introduced as macro domains.

Examples of moisturisers and humectants include cetyl alcohol, CARBOPOL® 934, ethoxylated castor oil, paraffin oils, lanolin and its derivatives. Silicone compounds such as silicone surfactants like DC® 3225C (Dow Corning) and/or silicone emollients, silicone oil (DC-200® ex. Dow Corning) may also be included. Sunscreens such as 4-tertiary butyl-4'-methoxy dibenzoylmethane (available under the trade name PARSOL® 1789 from Givaudan) or 2-ethyl hexyl methoxy cinnamate (available under the trade name PARSOL® MCX from Givaudan) or other UV-A and UV-B sun-screens may also be added. Lipids such as cholesterol, ceramides, and pseudo-ceramides, and ex-foliant particles such as polyethylene beads, walnut shells, apricot seeds, flower petals and seeds may also be present. Structurants such as maltodextrin or starch may be used to structure the bars. Inorganic electrolytes such as sodium chloride may be used to harden the bars.

Preferred bars may also include essential oils such as bergamot and citrus or insoluble extracts of avocado, grape, grapeseed, myrrh, cucumber, watercress, calendula, elder flower, geranium, linden blossom, amaranth, seaweed, gingko, ginseng and other plant extracts.

Further optional ingredients include chelating agents such as ethylene diamine tetra acetic acid, preservatives (e.g. GLYDANT®) antioxidants, and natural and synthetic perfumes.

Cationic polymers may be included as conditioners. These include POLYQUATERNIUM®, MERQUAT® polymers, and JAGUAR® polymers.

Other adjunct materials may include germicides and preservatives. These ingredients normally will be in amounts less than 2 wt %, usually less than 0.5 wt %.

Process

Processes for production of transparent soaps have been described by F. W. Wells in "Soap and Chemical Specialties", Vol. XXXI, No. 6 and 7, June and July 1955, which article is incorporated herein by reference.

In a second aspect the invention provides a process for making transparent soap bar of the first aspect, the process including the steps of:

(i) saponification of oils or fatty acids in presence of polyols to get a molten mass, where after complete neutralisation, the free alkali content measured as sodium hydroxide is not greater than 0.1%; and, (ii) molding the molten mass to get the bar, wherein 0.003 to 0.5 parts fluorescer and 0.05 to 10 parts $C_2$ to $C_3$ alcohol is mixed with the molten mass.

Excess free alkali may adversely affect colour. Above this range, the molten mass (and the resultant bars) may become yellowish or brownish. Bars having greater than 0.1% free alkali content were found to be dark brown.

In a preferred process, the free alkali content is not greater than 0.05%, more preferably not greater than 0.03%.

In a preferred process, the temperature of the molten mass is maintained below 100° C. during saponification. In a further preferred process, this temperature is maintained between 75 to 90° C. At higher temperature, the mass (and the resultant bars) may turn yellowish because of charring of raw materials. Further, at higher temperature, the increase in viscosity of the molten mass may adversely affect the ability of the ingredients to effectively mix with each other.

In a preferred process, an antioxidant is mixed with the oils or fatty acids before saponification. Antioxidants reduce oxidation of fatty acids and oils. Oxidised fatty acids or oxidized oils may result in yellowish bars. Preferred antioxidants include butylated hydroxytoluene (BHT), butylated hydroxyanisole (BHA) and tertiary butyl hydroquinone (TBHQ).

In a preferred process, the molten mass is agitated at tip-speed of 2 to 8 m/s. This facilitates mixing of the raw materials, especially the fluorescer with the saponified oils or fatty acids.

The invention will now be explained with the help of non-limiting exemplary embodiments.

EXAMPLES

Example-1

Formulation of Control and Preferred Transparent Soap Bars

TABLE 1

| Ingredient/wt % in bars | Control 1 | Control 2 | 1 | 2 |
|---|---|---|---|---|
| Anhydrous soap* | 35.0 | 35.0 | 35.0 | 35.0 |
| Propylene Glycol | 7.0 | 7.0 | 7.0 | 7.0 |
| PEG 200 | 5.0 | 5.0 | 5.0 | 5.0 |
| Glycerol | 21.0 | 21.0 | 21.0 | 21.0 |
| Sodium chloride | 1.0 | 1.0 | 1.0 | 1.0 |
| Sodium lauryl sulphate | 7.0 | 7.0 | 7.0 | 7.0 |
| Perfume | 1.0 | 1.0 | 1.0 | 1.0 |
| Isopropyl alcohol | 0 | 3.5 | 0 | 3.5 |
| TINOPAL ® CBSX | 0 | 0 | 0.01 | 0.01 |
| Water | 22 | 22 | 22 | 22 |
| Other minor ingredients to | 100 | 100 | 100 | 100 |

*The anhydrous soaps included a mixture of sodium salts of coconut fatty acids and sodium salts of ricinoleic acid. The Total fatty matter of all soap bars was 32 to 35 wt %.

Process

Coconut oil fatty acids and ricinoleic acid were saponified in presence of propylene glycol, glycerol and PEG-200 to get a molten mass. After complete neutralisation, the free alkali content measured as sodium hydroxide was found to be less than 0.03%. During neutralisation, the temperature was maintained at 85° C.

In another vessel; the perfume, TINOPAL® CSBX (whenever present) and isopropyl alcohol (whenever present) were mixed. This mixture was then mixed at 80° C. with the molten mass of soap.

Thereafter, sodium lauryl sulphate was added to the mixture, followed by molding the molten mass in a SCHICHT® cooler to get transparent soap bars. The bars were then weathered for about 24 hours, and then they were cut into smaller individual units of preferred dimensions described earlier. These unit sized bars were then weathered for 10 days. The bars were then stamped, flow-wrapped and packed into cartons.

Transparency of Control and Preferred Bars

All soap bars of Table 1 were transparent. Their transparency was in the range of 55 to 65%, i.e. 55 to 65% of incident light passed through the bars.

CIELAB b* Values and Lovibond® RYBN Colour of Control and Preferred Bars

The b* values and the colour (expressed as Y+5R on LOVIBOND® scale and measured as described earlier) of control and preferred bars of Table 1 is shown in Table 2.

TABLE 2

| Composition | b* | Lovibond ® Y+5R value |
|---|---|---|
| Control 1 | 0.68 | 3.5 |
| Control 2 | 0.6 | 3.5 |
| 1 | −3.75 | 1.4 |
| 2 | −4.67 | 1.4 |

The data in Table 2 indicates that only the preferred bars had b* value less than 0 and colour expressed as Y+5R on LOVIBOND® scale within the range of 0 to 3.

It will be appreciated that the illustrated examples provide transparent and water-white soap bars by adding a fluorescer at selective levels.

Although the invention has been described with reference to specific embodiments, it will be appreciated by those skilled in the art that the invention may be embodied in many other forms.

The invention claimed is:

1. Transparent soap bar comprising:

(i) 20 to 78 wt % total fatty matter and, (ii) 0.003 to 0.5 wt % fluorescer, wherein (i) CIELAB b* value of said bar at 0° viewing and 75° illumination is less than 0; and, (ii) color of said bar expressed as Y+5R on LOVIBOND® scale 0 to 3, and wherein said soap bar comprises 0.05 to 10 wt % $C_2$ to $C_3$ alcohol.

2. Transparent soap bar as claimed in claim 1 wherein said alcohol is isopropyl alcohol.

3. Transparent soap bar as claimed in claim 1 wherein 60 to 100% of said total fatty matter is alkali metal salts of fatty acids.

4. Transparent soap bar as claimed in claim 3 wherein 5 to 35% of said fatty acids is hydroxy fatty acids.

5. Transparent soap bar as claimed in claim 4 wherein said hydroxy fatty acids is ricinoleic acid or 12-hydroxy stearic acid or a mixture thereof.

6. Transparent soap bar as claimed in claim 1 comprising 10 to 50 wt % polyols.

7. Transparent soap bar as claimed in claim 1 wherein said fluorescer is water-soluble.

8. Transparent soap bar as claimed in claim 7 wherein said fluoresce is 4,4-bis(2-disulfonic acid styryl)biphenyl.

9. Transparent soap bar as claimed in claim 1 comprising less than 4 wt % free fatty acids.

10. Transparent soap bar as claimed in claim 1 comprising 10 to 35 wt % water.

11. A process for making transparent soap bar as claimed in claim 1 comprising the steps of:

(i) saponification of oils or fatty acids in presence of polyols to get a molten mass, where after complete neutralisation, the free alkali content measured as sodium hydroxide is not greater than 0.1%; and, (ii) molding said molten mass to get the bar, wherein 0.003 to 0.5 parts fluorescer and 0.05 to 10 parts $C_2$ to $C_3$ alcohol is mixed with said molten mass.

12. A process as claimed in claim 11 wherein the temperature of said molten mass is maintained below 100° C. during saponification.

13. A process as claimed in claim 11 wherein an antioxidant is mixed with said oils or fatty acids before saponification.

14. A process as claimed in claim 11 wherein said molten mass is agitated at tip-speed of 2 to 8 m/s.

* * * * *